US005497911A

United States Patent [19]

Ellion et al.

[11] Patent Number: 5,497,911

[45] Date of Patent: Mar. 12, 1996

[54] HAND-HELD UNIVERSAL DISPENSING CONTAINER WHICH OPERATES REGARDLESS OF ITS ORIENTATION

[76] Inventors: M. Edmund Ellion, 3660 Woodstock Rd., Santa Ynez, Calif. 93460; James C. Pfautz, 12360 Hogue La., Bealeton, Va. 22712

[21] Appl. No.: 300,108

[22] Filed: Sep. 2, 1994

[51] Int. Cl.[6] ..... B65D 35/28

[52] U.S. Cl. ..... 222/95; 222/107; 222/105

[58] Field of Search ..... 222/92, 95, 105, 222/107, 564

[56] References Cited

U.S. PATENT DOCUMENTS

| | | | |
|---|---|---|---|
| Re. 33,969 | 6/1992 | Richter | 222/105 X |
| 2,891,700 | 6/1959 | Maynard | 222/92 |
| 3,198,392 | 8/1965 | Wilson | 222/107 |
| 3,257,036 | 6/1966 | Micallef | 222/95 |
| 3,260,412 | 7/1966 | Larkin | 222/107 |
| 3,508,587 | 4/1970 | Mauch | 222/107 X |
| 4,322,020 | 3/1982 | Stone | 222/105 X |
| 4,893,731 | 1/1990 | Richter | 222/92 |
| 5,147,071 | 9/1992 | Rutter et al. | 222/92 |
| 5,156,300 | 10/1992 | Spahni et al. | 222/105 |
| 5,170,911 | 12/1992 | Della Riva | 222/105 |

FOREIGN PATENT DOCUMENTS

| | | | |
|---|---|---|---|
| 86/00868 | 2/1986 | WIPO | 222/105 |
| 91/14630 | 10/1991 | WIPO | 222/95 |

*Primary Examiner*—Andres Kashnikow
*Assistant Examiner*—Kenneth Bomberg
*Attorney, Agent, or Firm*—Donald D. Mon

[57] ABSTRACT

This invention relates to a hand-pump or pressurized container that can dispense the contents when held at any orientation. A flexible bladder with a dip tube having multiple openings in order to provide a flow path for the liquid regardless of the orientation of the container. In another embodiment, the liquid path is provided by the configuration of the inner surface of the bladder without the need of a dip tube.

14 Claims, 6 Drawing Sheets

HAND-HELD UNIVERSAL DISPENSING CONTAINER WHICH OPERATES REGARDLESS OF ITS ORIENTATION

FIELD OF THE INVENTION

This invention relates to hand-held dispensing containers from which a stream of liquid can be dispensed without entrapment of gas, while the container can be held in any orientation relative to the vertical.

BACKGROUND OF THE INVENTION

The conventional hand-pump spray-bottle and pressured-gas spray-can employ a single dip tube with an open end that extends into the liquid to be expelled. When the container is held upright, the open end of the dip tube extends into the liquid and, when the pump or valve is actuated, expels the liquid. However, if the container is inverted or held at any orientation where the open end of the dip tub is not immersed in the liquid, air or the pressurizing gas will be expelled instead of the desired liquid There is great interest in the industry for a spray bottle that can operate in any orientation. Several patents have been granted (e.g. Grothoff U.S. Pat. No. 4,775,879 and Ramsey U.S. Pat. No. 3,733,013) for containers that can operate either upright or completely inverted. These inventions require expensive unreliable check valves and still are limited to operation when they are completely vertical or completely inverted. To date there is no known spray bottle available which will operate at all orientations except for the one described in a recent patent application by Ellion and Pfautz (Ser. No. 08/241,845 dated May 12, 1994). This application describes a feed system that employs filters at the liquid inlets having pores of a size that prevent gas from entering the wetted filters as the result of surface tension forces, but does allow the liquid to pass freely. While such a container is workable and valuable, the cost of the filters may make its application to the mass market economically infeasible.

Additionally, the size of the filter pores must be changed for each liquid which has a different surface tension. Another disadvantage is that some media to be dispensed contain solid particles that would plug the pores and make the system inoperable. Consequently, one feed system will not be universally usable for all media.

The use of a flexible bladder to allow liquids to be expelled by action of a pump or a pressurized gas is well known for zero-gravity satellites and for vehicles such as airplanes which are not always oriented in the same position. A summary article is given in the Journal of Spacecraft and Rockets vol. 8 No. 1 Feb. 2, 1971 pages 83–88 by S. Debrok.

The use of flexible bladders also is well known for many other applications such as water pump systems on ranches where the bladder separates the air in the pressure tank from the water in order to prevent the water from becoming saturated with high pressure air which would come out of solution when expelled from the faucet with the undesirable effect of effervescence.

A flexible bladder has also been used in baby milk bottles to prevent the baby from ingesting air. There is, however, no known application of a flexible bladder for hand-held pump spray bottles or for pressurized aerosol cans in order to allow them to operate at any orientation.

It is the principal object of this invention to provide a universal hand-held dispensing container that is useful to provide a stream or a spray of any liquid medium without gas, when the bottle is held at any orientation.

It is an optional object of this invention to provide a feed system that operates automatically without requiring manipulation on the part of the user.

It is still another optional object of this invention to provide for the spray bottle that can be refilled with additional liquid.

It is yet another optional object of this invention to be able to operate the spray bottle on earth, and consequently in a gravity field or at any gravity level above or below the earth's gravity level.

It is another optional object of this invention to provide a bladder which can be made of inexpensive organic plastic material, and in such thin sections as to make the bladder very affordable.

BRIEF DESCRIPTION OF THE INVENTION

This invention is directed to a liquid-dispensing system in which a liquid to be dispensed is held in a novel closed flexible bladder. The bladder is housed in a container that contains a gas. The liquid contents can be dispensed regardless of the orientation of the container.

According to a preferred but optional feature of the invention, the gas pressure in a vented container is ambient, and a hand-operated pump connected to the bladder draws liquid from the bladder by exerting a negative pressure in the bladder relative to ambient. A nozzle discharges liquid that is withdrawn by the pump. The bladder contains liquid channel paths on its inner surface or is embossed with a novel configuration to provide liquid paths to the pump inlet.

According to another optional feature of the invention the container is closed, and the gas held by it is at a pressure higher than ambient. A release valve connected to the novel bladder, when opened, passes liquid from the bladder under pressure exerted by gas in the region between the bladder and the closed container.

In some embodiments, a dip tube extends into a conventional bladder for substantially its entire length, and connects to the pump or to the release valve. The dip tube has multiple entry ports through its wall along its length to assure that at least some ports will be open even if some others are closed by contact with the bladder. The bladder isolates the liquid from the gas, so that only liquid will be delivered. Also importantly, because the bladder is exposed to gas pressure on all sides, its progressive collapse around the dip tube will assure that some liquid will be in communication with some entry port at all times, so long as any liquid remains in the bladder.

According to a preferred but optional feature of the invention, the inner wall of the bladder is surface-configured so as to form continuous fluid paths along the bladder surface to the outlet, even when opposite bladder surfaces abut one another.

The above and other features of the invention will be fully understood from the following detailed description and the accompanying drawings, in which:

DETAILED DESCRIPTION OF THE INVENTION

Figure 1:
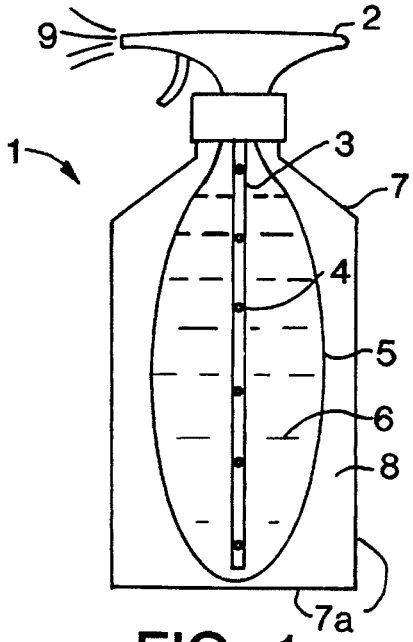
FIG. 1 illustrates a hand pump bottle with bladder and dip tube according to this invention.

FIG. 1 illustrates a hand-held spray bottle 1 according to this invention with a conventional hand pump 2 that can operate in any orientation. Such pumps are widely available. A dip tube 3 has multiple entry ports 4 along its length. A flexible bladder 5 surrounds the dip tube 3 and contains liquid 6 that is to be dispensed. The bladder is fabricated from polyethylene sheets or other conventional flexible material. The container 7 has small air inlet ports 7*a* (only two of which are illustrated) that admit air to the space 8 between the container 7 and the flexible bladder 5 to fill the void left by dispensed liquid 9. Liquid 6 held within the bladder 5 is maintained at approximately constant pressure by the air admitted to the container, and only liquid 6 contacts the dip tube 3. The result is that liquid can be pumped out of the bladder when the container is held in any orientation.

Figure 2:
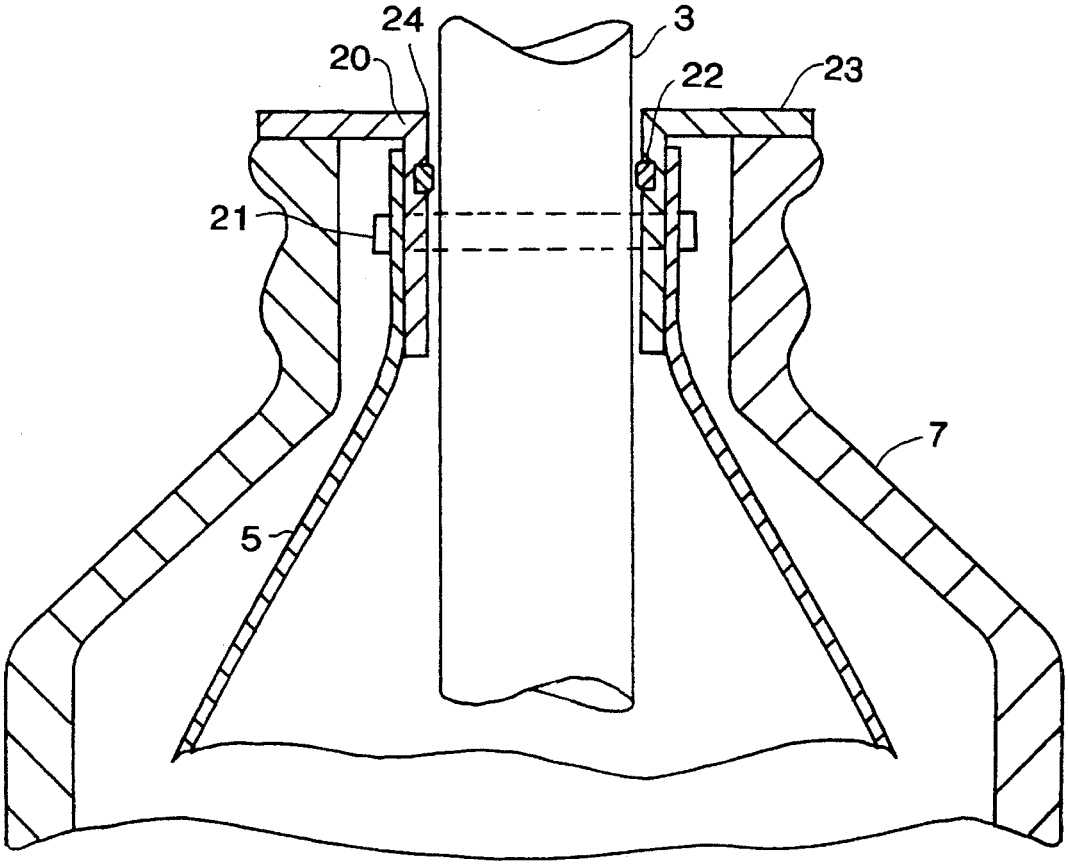
FIG. 2 illustrates one technique for installing the bladder and dip tube into the container.

FIG. 2 illustrates one means of assembling the spray bottle. A support structure 20 has a clamp ring 21 that seals bladder 5 to the support structure 20. The dip tube 3 is inserted through the center of the support structure 20 and is sealed with an "0" ring 22. The support structure 20 has a flange 23 that prevents it from entering completely into container 7. The clamp 21 can be any one of the conventional types such as "C" clamps or a common elastic band.

Figure 3:
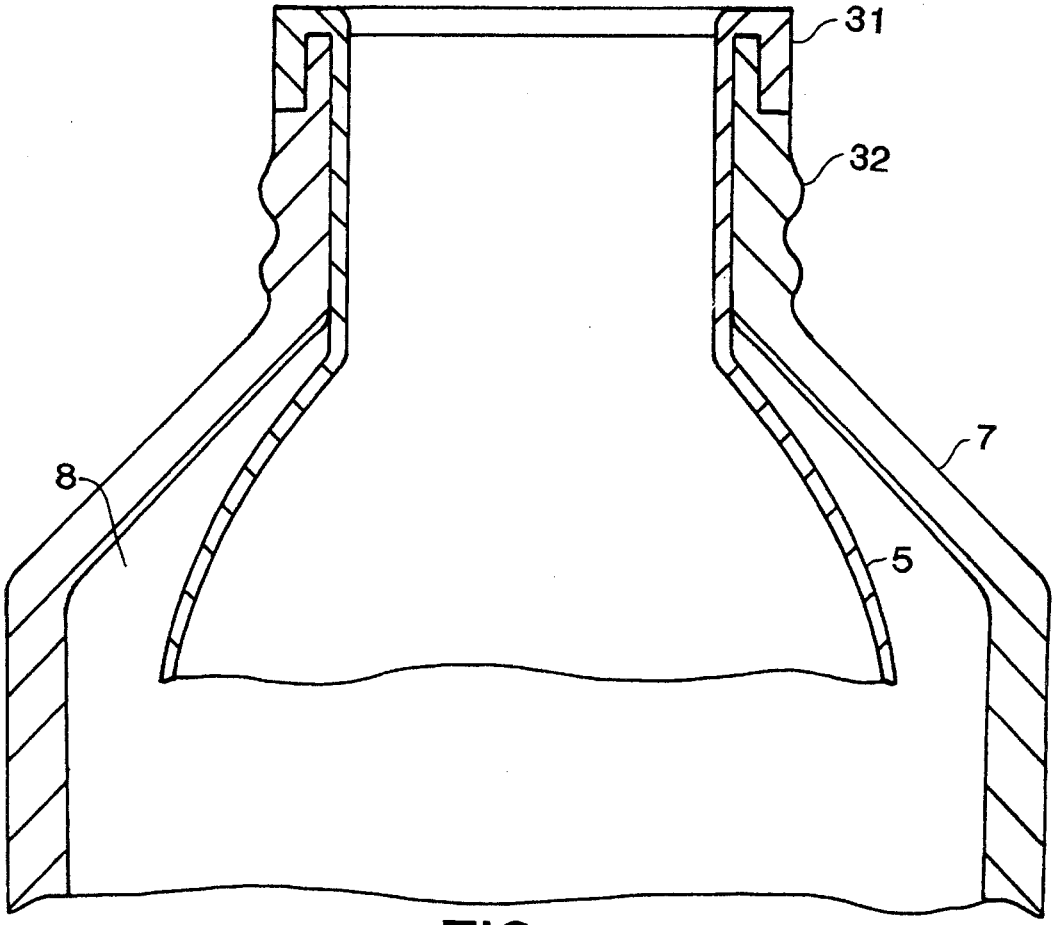
FIG. 3 illustrates a more economical technique for installing the bladder into the container.

FIG. 3 illustrates an alternative more economical design to separate the liquid in bladder 5 from the external air and from the air 8 contained between the bladder 5 and the container 7. The lip of the bladder 31 is folded over the container 7 to accomplish the seal and is held in place when the hand pump is attached by threads 32.

In operation, the flexible bladder 5 attached to the support structure 20 in FIG. 2 would be inserted into the container prior to filling with liquid. The bladder 5 would then be filled in the conventional method through the opening 24 that eventually will be occupied by the dip tube 3. Following the filling operation, the dip tube 3 and the hand pump 2 will be installed as in the conventional bottle.

In these embodiments a smooth-walled bladder may be used, because the perforated dip tube will assure access to some region containing liquid.

Figure 4:
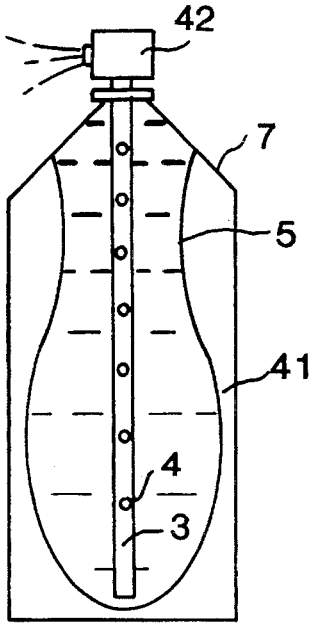
FIG. 4 illustrates a pressurized spray can with bladder and dip tube according to this patent.

FIG. 4 illustrates a pressurized can according to this invention. In the embodiment of FIG. 4, container 7 is not vented. Instead it has a continuous wall in order that it can hold gas 41 under pressure inside it, and around bladder 5. Valve 42 is a normally closed pressure-release type of the class generally used with pressurized spray bottles. A dip tube 3 extends into the bladder, with perforations 4 along its length.

Here it will be observed that in the pressurized embodiment, a dip tube is optional, and the opening of the bladder would connect to the valve, instead of a dip tube. Because of the configuration of the bladder as explained in the paragraphs next below, it is unlikely that the bladder would fold over and isolate parts of the contents from the valve. Also, it is likely that the container will be held in its inverted position from time to time, which would cause any fold to become unfolded. Also, peripheral pressure on the bladder will tend to force any liquid toward the valve when the valve is opened.

The dip tube may be eliminated under certain conditions. In order to determine the need for a dip tube, it will be instructive to consider the forces which will act on the bladder. It is assumed that there is no dip tube in the following discussion.

In order to simplify these teachings, the consideration of the folding of the bladder as it collapses will be eliminated and the bladder will be treated as a single smooth monotonic surface. This simplification is possible since it is not necessary to determine the actual stresses and strains in the bladder, but merely to determine the general effective shape of the bladder. Thus the analysis ca be more qualitative than quantitative.

Figure 5:
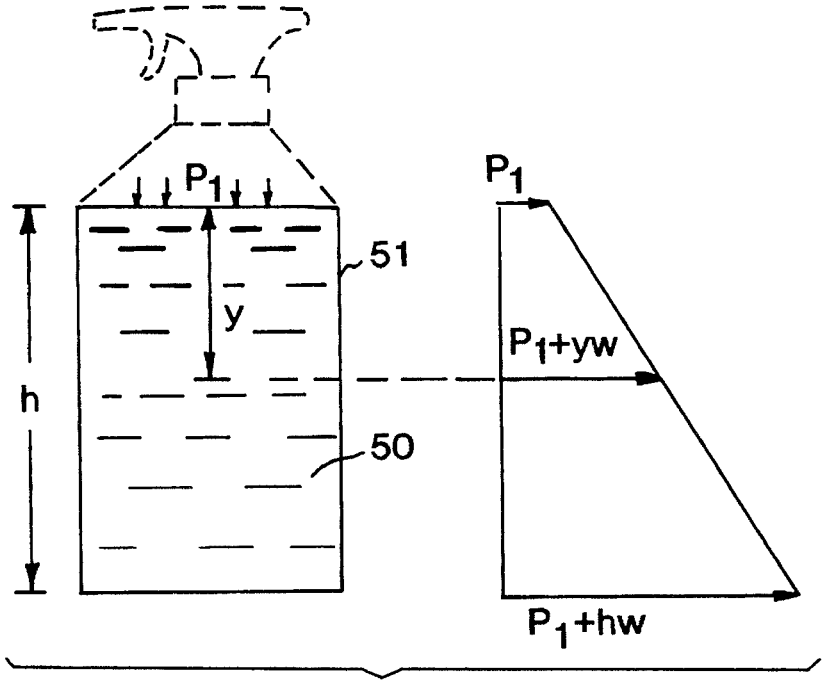
FIG. 5 illustrates the variation of pressure in the liquid container.
Figure 6:
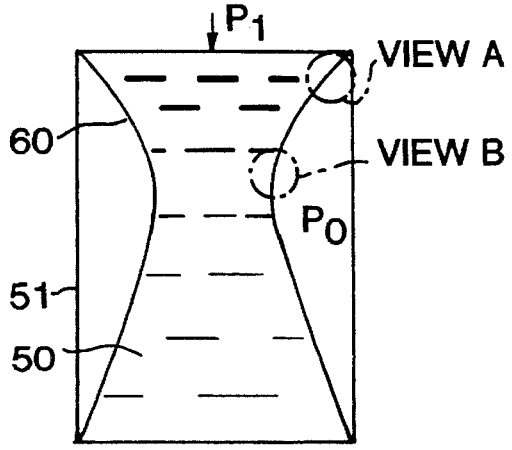
FIG. 6 illustrates the deformation of the bladder as liquid is withdrawn.

FIG. 5 illustrates a liquid 50 contained in a cylindrical container 51 that has a height of h and is held in a vertical orientation. The pressure at the top surface is represented as $P_1$. The increase in the level of pressure over the value of $P_1$ at any location would equal the product of the vertical distance from the top surface to the point of interest y and the weight per unit volume of the liquid w:

$$P=P_1=yw \quad (1)$$

where:

P=Pressure at any location in the liquid $P_1$=Pressure at the top surface of the liquid y=Vertical distance from top surface to point of interest in the liquid w=Weight per unit volume of the liquid FIG. 6 illustrates the configuration of the bladder when some of the liquid 50 has been pumped out and the resulting pressure differential has caused the bladder 60 to move away from the container walls and collapse around the remaining liquid. The illustration is for a cylindrical container 51 having a large diameter top relative to the height.

Figure 7A:
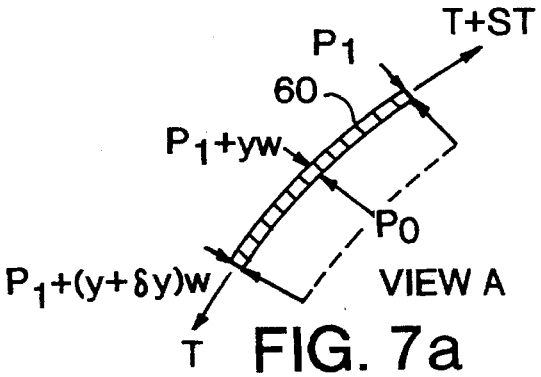
FIG. 7*a–b* shows the free-body of the bladder acted on by the pressures and the tension forces.
Figure 7B:
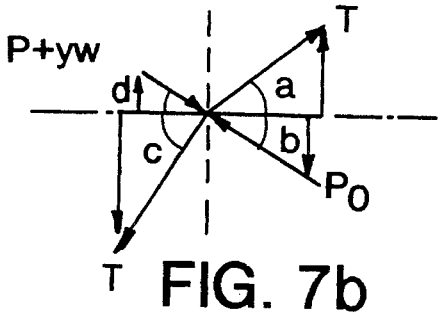

FIG. 7*a* illustrates an enlarged representation of view A of FIG. 6. The section of bladder 60 is acted on by the internal pressure P, the external pressure $P_o$ and the tensile forces that result from the weight of the liquid. The pressure forces act perpendicular to the bladder surface and the tensile forces act tangentially to the bladder surface. In structural nomenclature, this view is termed the "free-body" that has a unit area over which the pressure acts and a unit length over which the tensile force acts. As a free-body, the resolution of all forces along any axis must add up to zero. Referring to FIG. 7*b*, the pressure and tensile forces are shown as being resolved into horizontal and vertical forces. Since the section of the bladder under consideration is infinitely small, the ST and SY can be neglected and the resolved forces become:

$$\text{Horizontal: } T\cos(a)+(P_1+yw)\cos(d)=T\cos(c)+P_o\cos(b) \quad (2)$$

$$\text{Vertical: } T\sin(a)+P_o\sin(b)=T\sin(c)+(P_1+yw)\sin(d) \quad (3)$$

It should be noted that the contour of the bladder surfaces is unique for any given value of internal pressure, tensile force and external pressure as well as by the angles a, b, c, and d.

Figure 8A:
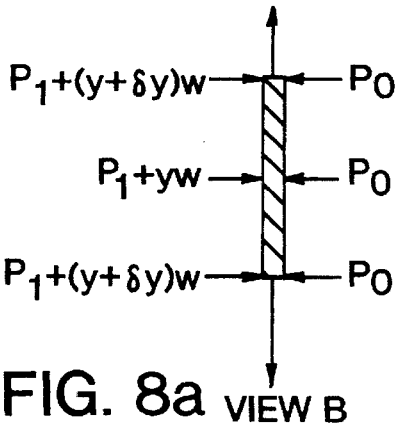
FIG. 8*a–b* shows the free-body of the bladder at the location where the surfaces are vertical and the inner pressure equals the external pressure.
Figure 8B:
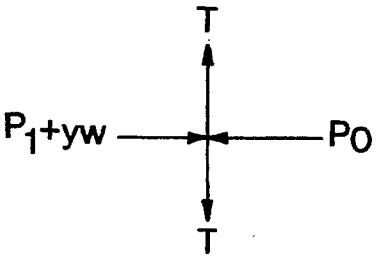

FIG. 8*a* illustrates the section of the bladder at the view B location shown in FIG. 6. Since the bladder section is tangent to the vertical at this location, the resolution into the vertical and horizontal forces coincides with the actual forces as illustrated in FIG. 8*b*. It is clear then that the internal pressure equals the external pressure since the tensile forces act in the vertical direction only. This conclusion can also be reached from equations (2) and (3) with angles a and c equal to 90 degrees and angles b and d equal to zero; it is seen that the internal pressure equals the external pressure:

$$P_1+yw=P_o \quad (4)$$

This discussion has shown, in a simplified fashion, that the pressure within the bladder equals the external pressure at the location where the bladder surfaces are vertical.

Figure 9:
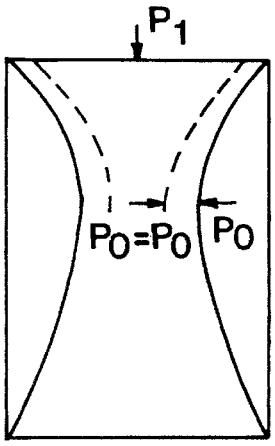
FIG. 9 illustrates the change in the bladder contour as the entrance size decreases.

Consider FIG. 9 that illustrates the same top surface pressure $P_1$, external pressure $P_o$ and tensile force but with a decreasing dimension at the top of the bladder. It has been shown that the bladder surface will be vertical at the location where the internal pressure equals the external pressure, $P=P_o$. This is also the location where the sides of the bladder are closest together as can be seen by examining FIG. 9.

Figure 10:
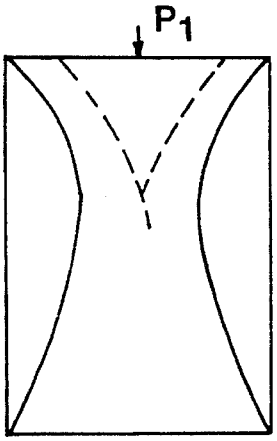
FIG. 10 illustrates the bladder when the sides first come in contact with each other and the pressure inside the bladder equals the external pressure.
Figure 11:
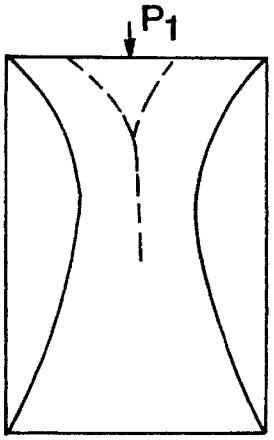
FIG. 11 illustrates the bladder after more liquid is withdrawn and the contact location is above the first contact position. The pressure internal to the bladder in this case is lower than the external pressure and the bladder has collapsed to seal the flow of liquid to the pump.

FIG. 10 illustrates the configuration when the bladder surfaces contact one another. The contact takes place at the location where the bladder slope is vertical and consequently where the internal pressure equals the external pressure. Since the internal pressure at this first contact location is equal to the external pressure, there is no resulting force to hold them together and as a result will not prevent the liquid from flowing through that location to the pump inlet. However, as the diameter of the top of the bladder is further decreased (FIG. 11), the contact area increases into the location where the internal pressure is lower than the external pressure as seen from equation (1). The result is that the bladder surfaces are held firmly together and will prevent the flow of liquid to the pump inlet.

Figure 12A:
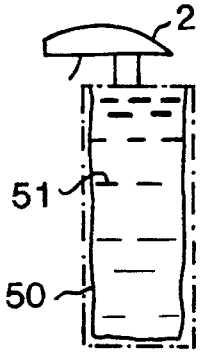
FIG. 12*a–c* illustrates a collapsing bladder having a ratio of height to diameter of less than 4.
Figure 12B:
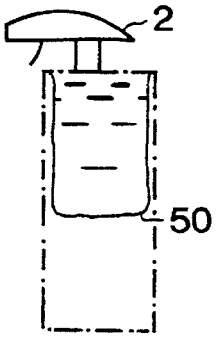
Figure 12C:
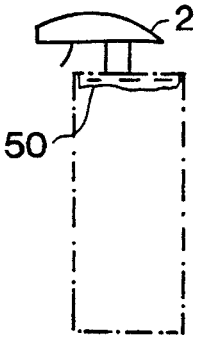

For small hand pump spray bottles having relatively wide entrance openings (e.g. 7 oz. bottle approximately 2.5 inches in diameter and 5.5 inches long) the contents can be pumped out of a conventional bladder without the need for a dip tube. FIG. 12 illustrates one possible shape of the bladder 50 for various amounts of the contents remaining. FIG. 12*a* illustrates the bladder 50 when it is completely full of liquid 51. FIG. 12*b* illustrates the bladder when half full. FIG. 12*c* illustrates the bladder 50 almost empty. It should be noted that the bladder never forms a restriction that prevents the liquid from being drawn into the pump.

Figure 13:
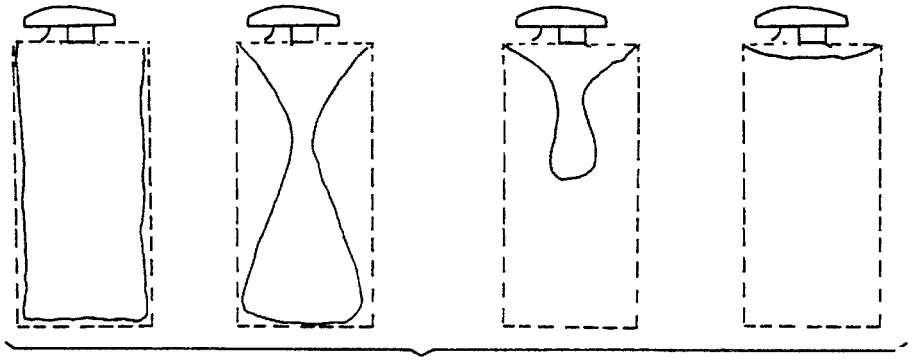
FIG. 13 illustrates another bladder having a ratio of height to diameter of less than 4 but containing a less dense liquid than in FIG. 12.

FIG. 13 illustrates another possible shape of the same bladder as FIG. 12 as liquid is drawn out of it. The bladder will collapse as illustrated if the liquid is relatively dense compared to the elasticity of the bladder in order to hold the bladder in an elongated position. The bladder will collapse as illustrated in FIG. 12 if the liquid is relatively less dense and allows the external pressure to raise the bladder as liquid is withdrawn. In either case, the liquid can be withdrawn from the bladder without the aid of a dip tube for a bladder that is configured with a length to diameter ratio of less than about 4.

Tests with various flexible bladder materials such as polyethylene having thicknesses up to 0.003 inches have been performed during the development of this invention. These tests with an upright container indicated that a bladder having a ratio of length to diameter equal to 4 or less will not form a restriction near the top that would prevent the water from being pumped out of the bladder unless subjected to conditions which increase the body forces appreciably or the container is left unused for several hours. The conclusion is that a hand pump spray bottle having a ratio of length to diameter equal to about 4 or less will operate at any orientation without a dip tube under some restrictive conditions with some liquids.

Figure 14A:
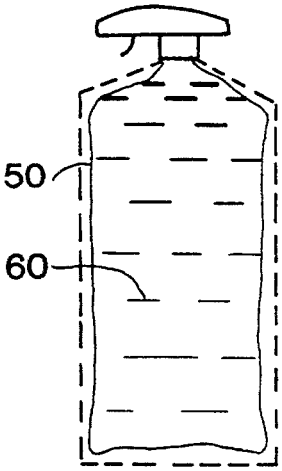
FIG. 14*a–b* illustrates a typical 24 fl. oz. hand pump spray bottle completely full in FIG. 14*a* and a half empty in FIG. 14*b* to show that the bladder will collapse and block the flow of liquid to the pump.
Figure 14B:
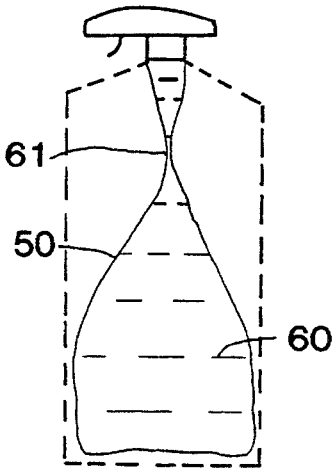

For large capacity spray bottles, the entrance and top are usually made much smaller than the main body so that the hand pump can be held conveniently. A typical hand pump spray bottle containing 24 oz. of liquid has approximate dimensions of a 0.8 inch entrance and top section, and a 4 by 2 inch rectangular main body that is 8 inches long. FIG. 14 illustrates the operation of the conventional bladder 50 in this bottle with no dip tube. FIG. 14*a* illustrates the bladder 50 full of liquid 60. In FIG. 14*b*, the liquid 60 in the lower portion of the bladder 50 is sealed from the pump by the collapsed bladder at position 61. This configuration bottle with a conventional bladder requires a dip tube with multiple entrances in order to operate at any orientation, as has been described earlier in this specification, when a smooth walled bladder is used.

Figure 15:
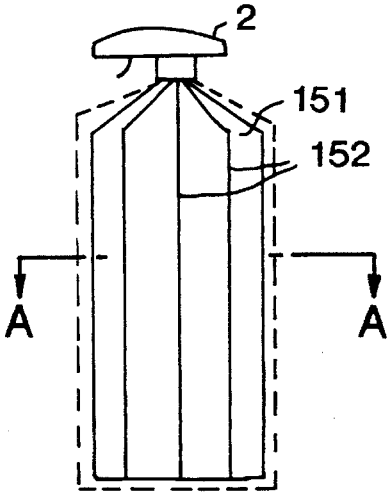
FIG. 15 illustrates a novel bladder that maintains a path to the pump without the need of a dip tube.

FIG. 15 illustrates a solution to the collapsed bladder problem that does not require a dip tube. In this solution, the inner surface 150 of bladder 151 is surface-configured to have channels 152 that do not form a seal between the sides of the bladder when the bladder collapses. FIG. 15 shows that the channels run from the bottom of the bladder 151 to the pump's inlet. They are bounded by thickened sections 151*a*, which act as columns to support the channels against collapse.

Figure 16A:
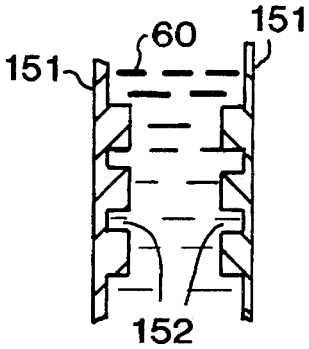
FIG. 16*a–c* illustrates the novel bladder with varying amounts of liquid.
Figure 16B:
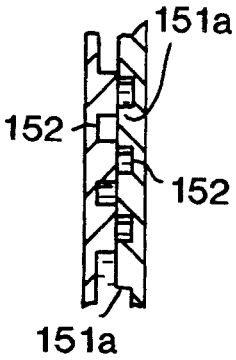
Figure 16C:
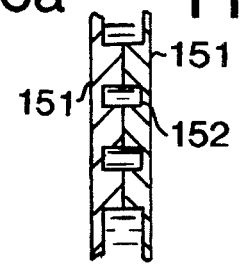

FIG. 16 is a view along section A—A in FIG. 15. The two opposing surfaces of the novel bladder 151 are illustrated in FIG. 16*a* wherein the bladder contains a relatively large amount of liquid 60. These surfaces are then well-separated. FIG. 16*b* illustrates the condition when sufficient liquid has been withdrawn so that the two sides of the bladder can make contact with one another. FIG. 16*b* illustrates the smallest channel path 152 for the liquid 60 since the two sides of the bladder line up but only the thickened sections 151*a* between the channels make contact with one another. FIG. 16*c* illustrates the maximum open channel size when the two sides of the bladder 151 make contact as shown. Since a typical pump creates less than 4 psi drop in the liquid pressure for only an extremely short time, the channel paths 152 will not be filled with the thinner sections of the bladder.

Figure 17:
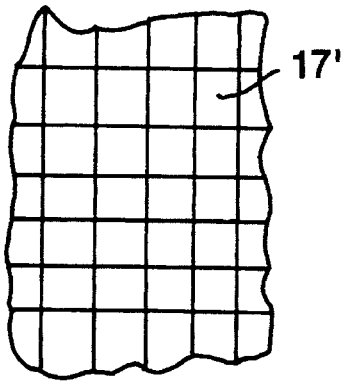
FIG. 17 illustrates a less expensive novel bladder that allows liquid to reach the pump without a dip tube.

An alternate, less expensive novel bladder design that will prevent the bladder from collapsing and consequently allow all of the liquid to reach the inlet to the pump is illustrated in FIG. 17. This bladder can be fabricated from a uniform thickness flexible material that is surface-configured with a defined pattern. The material can be any one of many available such as polyethylene. This embodiment enables a very light-weight thin sheet of organic plastic such as polyethylene to be used. The saving of material by reduction of thickness of the bladder and the elimination of the dip tube, is very important in a mass market.

By way of example, FIG. 17 illustrates on an enlarged scale a surface configured square pattern 171. This pattern may be considered indented or embossed, but for convenience it will be regarded as indented in the surfaces which face each other.

Figure 18:
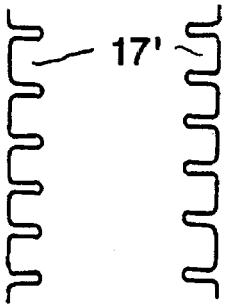
FIG. 18 shows a cross section of a square indenting pattern.
Figure 19:
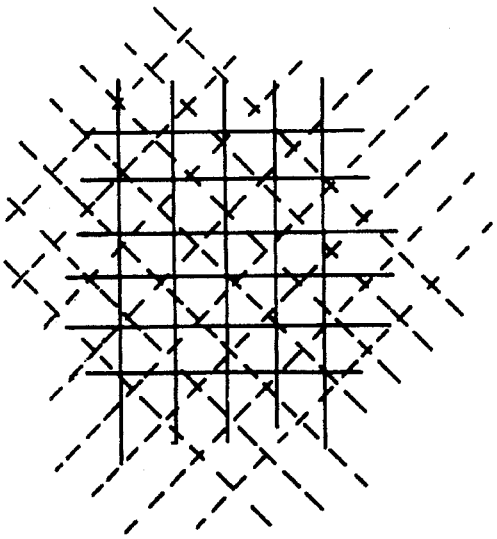
FIG. 19 illustrates that the opposing sides of the bladder have indented squares orientated at an angle from one another to provide a flow path to the bladder outlet.
Figure 20:
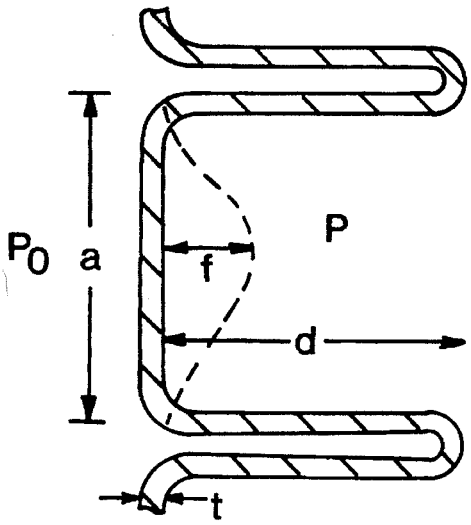
FIG. 20 is an enlarged view of one square to illustrate deformation of the bladder under pressure.

The bladder is made from two flexible sheets, both of which are indented, with the square's openings facing each other as shown in FIG. 18. The squares on one sheet are aligned 45 degrees from the square on the other sheet so that when the two contact, there always remains a continuous path for the liquid to reach the pump inlet as illustrated in FIG. 19 with one side shown in phantom. The edges of the sheets are not indented in order to allow the two sheets to be bonded together at the edges by a thermal process or other convenient technique in order to form the bladder. FIG. 20 illustrates an enlarged view of one of the squares. It will be observed that the thickness is uniform throughout the pattern, and that neither surface of the material is planar. However, their surface configurations are different.

The required length a of the sides of the squares and the depth d of the squares can be estimated from standard structural analysis. It is required that the material be sufficiently strong so that the squares will not collapse as the result of the differential pressure acting on the bladder. The pressure on the inside is determined mainly by the performance of the pump, the pressure on the outside being ambient. To be conservative, it is assumed that the deflections of the square will be small so that elastic theory can be applied to estimate the deflection of the squares. Also to be conservative, it can be assumed that the pump is capable of drawing a perfect vacuum, i.e. the differential pressure is equal to 14.7 psi.

The deflection of the square as shown greatly enlarged in FIG. 20 can be calculated from standard structural analysis available in most text books on the subject or in Mark's Mechanical Engineer's Handbook Page 480 4th Edition McGraw Hill Book Company:

$$f=[15a^4K(P_o-P)]/(\pi^5t^3E) \quad (5)$$

where:

f=deflection of the square surface a=length of the sides of the square

K=a factor depending on the type of support of the square (K=0.3) for non-fixed supports on all sides)

$P_o$–P=differential pressure across square surface (14.7 psi)

t=thickness of the material

E=Modulus of elasticity

From the equation it will be observed that the depth d must be at least proportionate to the fourth power of the length of the sides of the squares, and inversely proportionate to the third power of the thickness of the bladder material.

An example will prove instructive in determining the size of the squares and the depth d that will maintain a liquid flow path to the pump input.

Assume the bladder material is polyethylene in a flexible mode that has the following properties:

t=0.002 in.

a=0.070 in.

K=0.30

E=300,000 psi

From equation (5) with these values and the extreme pressure differential of 14.7, the deflection f equals 0.00217 in. Consequently, the square must be at least 0.003 in. deep to prevent the square passage from closing and allow the liquid path to the pump to remain open. Since the analysis requires several assumptions and consequently is not rigorous an indented square having a maximum dimension of 0.070 in. sides and minimum dimension of 0.006 depth would be chosen. A prototype bladder of this type has pumped water successfully from a typical 24 FL oz. bottle having a top bladder size of 0.8 in. a height of 8 in. and a main body 2 by 4 in., approximately. It will be noted that the indented portions on both sides are re-entrant in nature, rather than monolithic. This enables a bladder to be made with a uniform wall thickness that can readily be formed between calendar rolls, without altering the wall thickness by lateral movement of the material.

While most of the discussion has been for hand-pump containers it should be obvious to one skilled in the art that the discussions are equally valid for the pressurized cans. Also the embossment in the illustration is only one of many that are possible to those skilled in the art.

Figure 21:
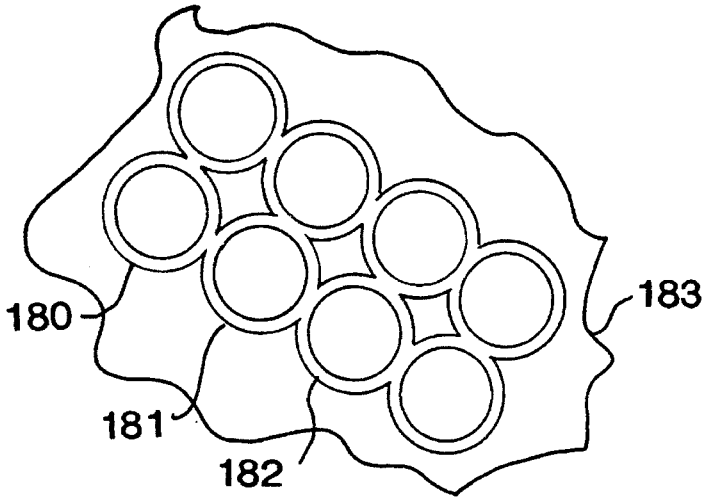
FIG. 21 shows series of circular indentations in a surface of the bladder form a serpentine flow path to the bladder outlet.

FIG. 21 shows series of circular indentations 180, 181, 182, in a surface of bladder 183. The series is in the inwardly facing surfaces of the bladder wall. A similar series on an opposite face, when they abut overlap to form a serpentine path, past any fold or abutment of these surfaces in the same sense that the rectilinear indentations do.

This invention is not to be limited by the embodiments shown in the drawings and described in the specification which are given by way of example and not of limitation, but only in accordance with the scope of the appended claims.

We claim:

1. A hand-held dispensing container for dispensing gas-free liquid comprising:

a rigid holder having an internal chamber;

a bladder in said chamber for containing a liquid to be dispensed, said bladder having a flexible wall forming a cavity to receive said liquid;

normally closed valve means to retain said liquid in said bladder when closed, and to permit flow of said liquid from said bladder when open;

means to exert a differential pressure between the inside and outside of said wall; and said bladder wall having interior facing surface which abut as liquid is withdrawn from the container, said surfaces being surface configured with indentations which overlap one another upon abutment to create a serpentine channel from the inside of the bladder, along the interior facing surfaces, to an outlet from the bladder.

2. A dispensing container according to claim 1 in which said holder is vented to atmosphere, and in which said means to exert a differential pressure is a hand-operated pump with an inlet and an outlet, said pump inlet opening into said bladder cavity, and said outlet opening to atmosphere, said pump when actuated, exerting a negative pressure in said cavity, and opening said valve means to cause liquid to exit the container.

3. A hand-held dispensing container according to claim 1 in which said bladder has a dimension of length and of width, whose ratio is less than about 4.

4. A hand-held dispensing container according to claim 1 in which said holder is a container closed to atmosphere, and in which said means to exert a differential pressure is a pressurized charge of gas inside said chamber and outside of said bladder.

5. A hand-held dispensing container according to claim 1 in which said indentations are series of circles, and in which the orientation of the series of circles on the facing surface lying at an angle to each other when said surfaces abut.

6. A hand-held dispensing container according to claim 5 in which said walls are surface-configured on both their interior-facing surface and on their exterior-facing surface, the said interior-facing surfaces having said circular indentations, the exterior-facing surfaces having re-entrant portions indented to bound said circles, the thickness of the material being uniform throughout.

7. A hand-held dispensing container according to claim 6 in which the depth of said indentations are configured to prevent the differential pressure from closing the flow path for the liquid to exit.

8. A hand-held dispensing container according to claim 6 in which said interior facing surfaces are formed on one side of a sheet which initially has a uniform thickness between co-planar surfaces configured one side by permanently yielding the material so that the indented circles are formed by thinner material than the original thickness of the material.

9. A hand-held dispensing container according to claim 1 in which said channels are bounded by thickened wall portions which prevent collapse of said wall that could close said channels.

10. A hand-held dispensing container according to claim 1 in which said indentations are rectilinear and in which the orientation of the indentations on the facing surfaces lying at an angle to one another when said facing surfaces abut.

11. A hand-held dispensing container according to claim 10 in which said walls are surface-configured on both their interior-facing surface and on their exterior-facing surface, the said interior-facing surfaces having said rectilinear indentations, the exterior-facing surfaces having re-entrant portions indented to bound said rectilinear indentations, the thickness of the material being uniform throughout.

12. A hand-held dispensing container according to claim 11 in which the depth of said indentations is at least proportionate to the fourth power of the length of the sides of the squares and inversely proportionate to the third power of the thickness of the bladder material.

13. A hand-held dispensing container according to claim 10 in which said interior facing surfaces are formed on one side of a sheet which initially had a uniform thickness between co-planar surfaces, configured on one side by permanently yielding the material so that the indentations are formed by thinner material than the the original thickness of the material.

14. A hand-held dispensing container according to claim 10 in which said angle is about 45 degrees.

* * * * *